US007353746B2

(12) United States Patent
Kutella

(10) Patent No.: US 7,353,746 B2
(45) Date of Patent: Apr. 8, 2008

(54) TWO-STAGE HAND PUMP

(75) Inventor: James D. Kutella, Lake Oswego, OR (US)

(73) Assignee: K-Pump, Lake Oswego, OR (US)

( * ) Notice: Subject to any disclaimer, the term of this patent is extended or adjusted under 35 U.S.C. 154(b) by 0 days.

(21) Appl. No.: 11/387,346

(22) Filed: Mar. 23, 2006

(65) Prior Publication Data

US 2007/0221056 A1 Sep. 27, 2007

(51) Int. Cl.
*F04B 9/14* (2006.01)
*F15B 15/14* (2006.01)

(52) U.S. Cl. ..... 92/61; 92/6 R; 417/487

(58) Field of Classification Search ..... 92/6 R, 92/61, 182; 417/487
See application file for complete search history.

(56) References Cited

U.S. PATENT DOCUMENTS 670,811 A 3/1901 Phelps
753,530 A * 3/1904 Ten Eyck ..... 92/6 R
3,224,378 A * 12/1965 Graham ..... 92/182
5,807,078 A 9/1998 Chen
5,997,256 A 12/1999 Gunther
6,135,733 A 10/2000 Wu
6,257,849 B1 7/2001 Wu
6,299,420 B1 10/2001 Saputo et al.
6,325,601 B2 12/2001 Wu
6,676,390 B2 1/2004 Wang

OTHER PUBLICATIONS

Brochure on K-Pump Models SK100 and K200.

* cited by examiner

*Primary Examiner*—Michael Leslie
(74) *Attorney, Agent, or Firm*—Chernoff Vilhauer McClung & Stenzel, LLP

(57) ABSTRACT

A hand pump for inflating rafts or similar inflatables has a first piston with a relatively low pumping volume which is capable of pumping relatively small volumes of air into a raft as the raft becomes full and is approaching its maximum pressure, and a second piston with a larger pumping volume that can pump larger volumes of air into a raft when it is empty or only partially filled. Both pistons are operated with a single plunger. When the plunger is rotated in a first direction to a first position a locking mechanism allows it to operate only the first piston, and when the plunger is rotated in a second direction to a second position the locking mechanism allows it to operate only the second piston.

3 Claims, 8 Drawing Sheets

TWO-STAGE HAND PUMP

BACKGROUND OF THE INVENTION

The subject invention relates to a pump for inflating rafts and similar inflatable devices, and in particular to such a pump which can provide either a large volume of air per stroke for initially filling the inflatable device, or a smaller volume of air per stroke for topping off a substantially filled inflatable device when its internal pressure has increased.

Many inflatable devices have to be filled or have air added to them at a remote location where only a hand-operated pump is available. Many inflatables, such as river rafts, contain a large volume of air. In order to fill them in a reasonable time with a hand pump the pump needs to deliver a relatively large volume of air with each stroke. However, as the raft approaches full inflation pressure, which is around 3 PSI, it becomes very difficult to operate a large volume hand pump. Thus, it is common to rely first on a high volume pump to initially fill the raft in the first instance, and then rely on a second lower volume pump which is easier to operate at higher pressures to top off the raft from time to time as required. This requires carrying two pumps in the raft. While two-stage pumps which serve both needs are available, they either are too large or cumbersome to carry on a-raft, or they have a pumping mechanism which is unreliable when exposed to water and sand, which a pump carried on a raft ultimately would be. Thus, the need remains for a single hand-operated pump, of a size that can be carried on a raft, having a simple dependable pumping mechanism which is not affected by sand and water that can provide both high volume of air to fill an empty or nearly empty raft and still be easy to operate as the raft becomes full and the pressure increases.

BRIEF SUMMARY OF THE INVENTION

This is accomplished in the subject invention by providing a pump having a first chamber with a first piston and a second chamber with a second piston. A plunger is attached to the first piston and a locking mechanism causes activation of the plunger to move the first piston in the first chamber without moving the second piston in the second chamber when the plunger is first rotated in a first direction to a first position, and causes activation of the plunger to move the second piston in the second chamber without moving the first piston in the first chamber when the plunger is first rotated in a second direction to a second position.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
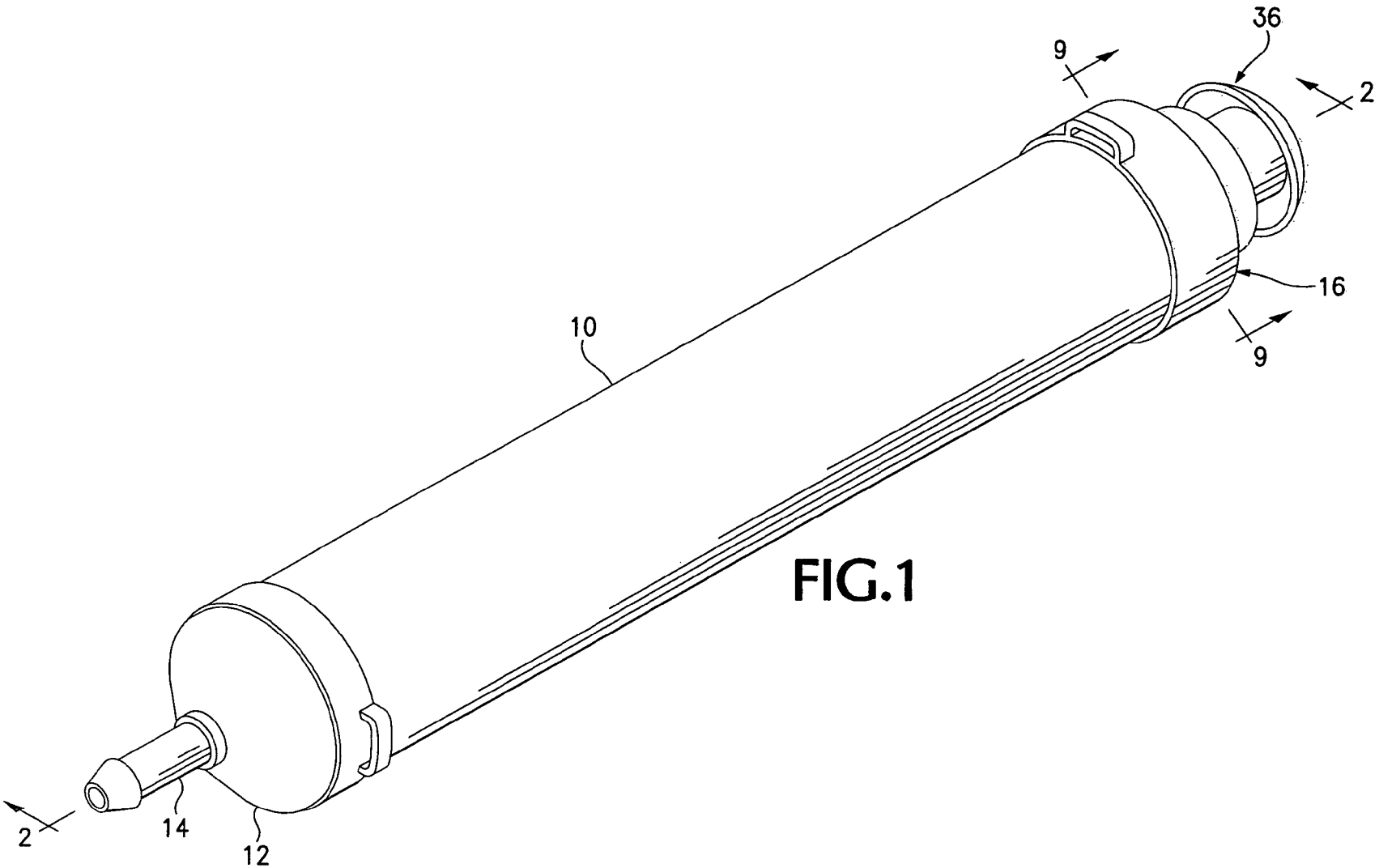
FIG. 1 is a perspective view of a pump embodying the subject invention.
Figure 2:
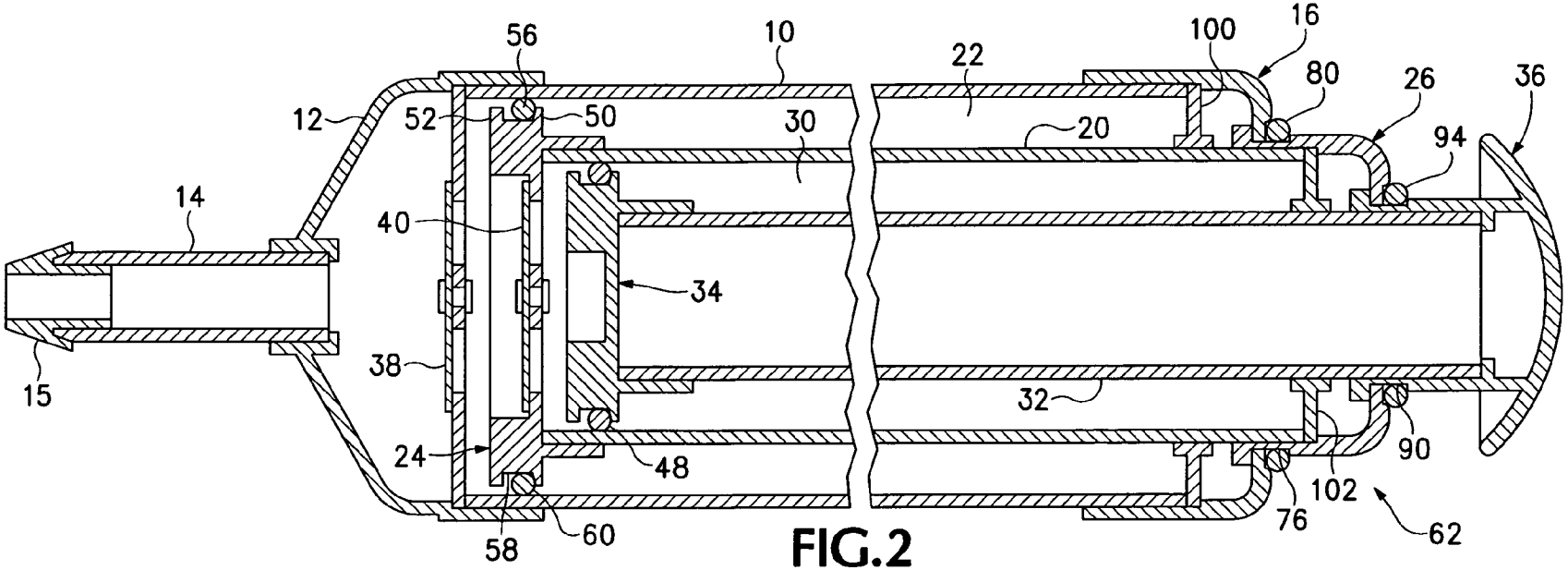
FIG. 2 is a foreshortened cross-sectional view taken on the line 2-2 of FIG. 1.
Figure 3:
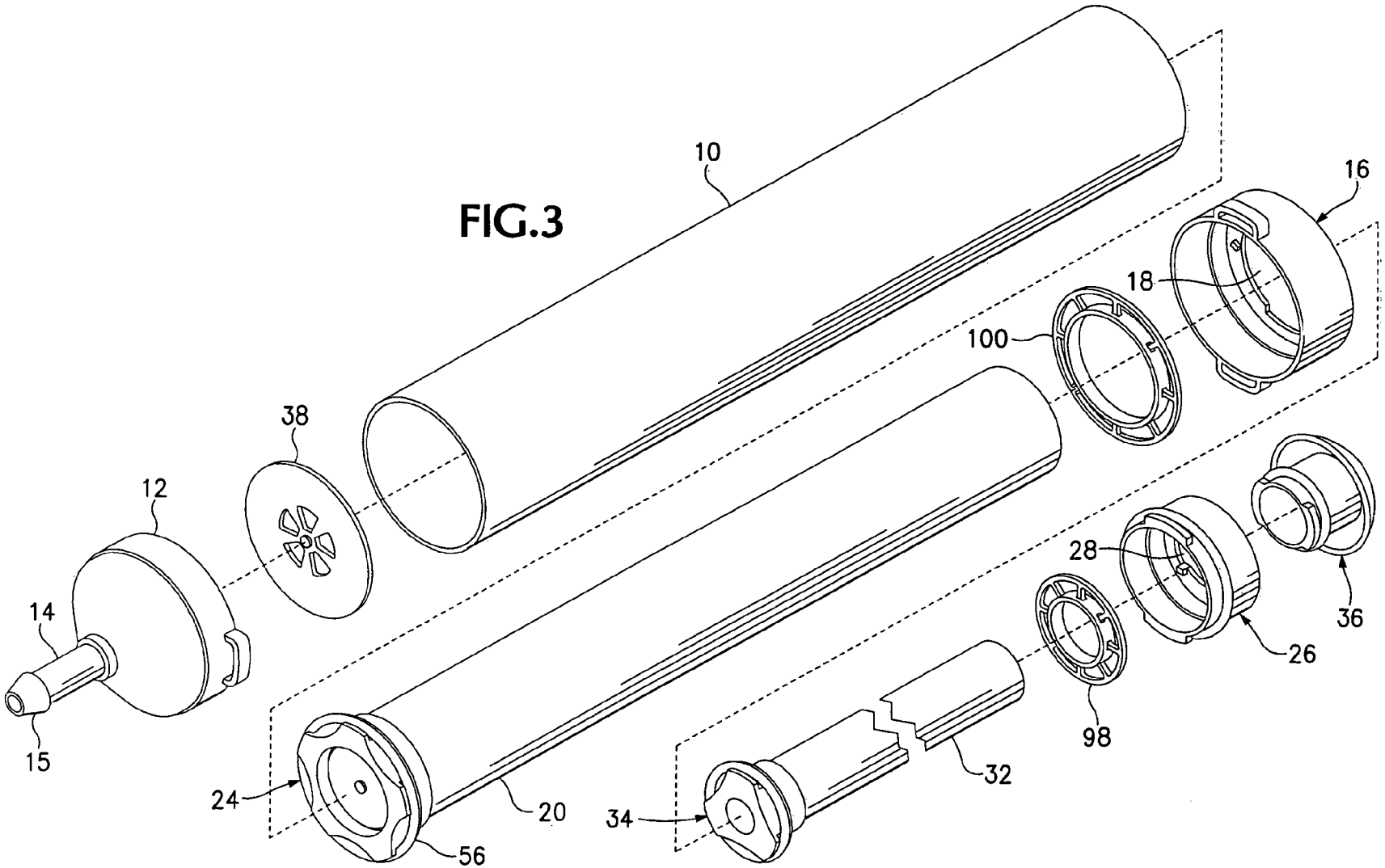
FIG. 3 is an exploded view of the pump of FIG. 1.
Figure 4:
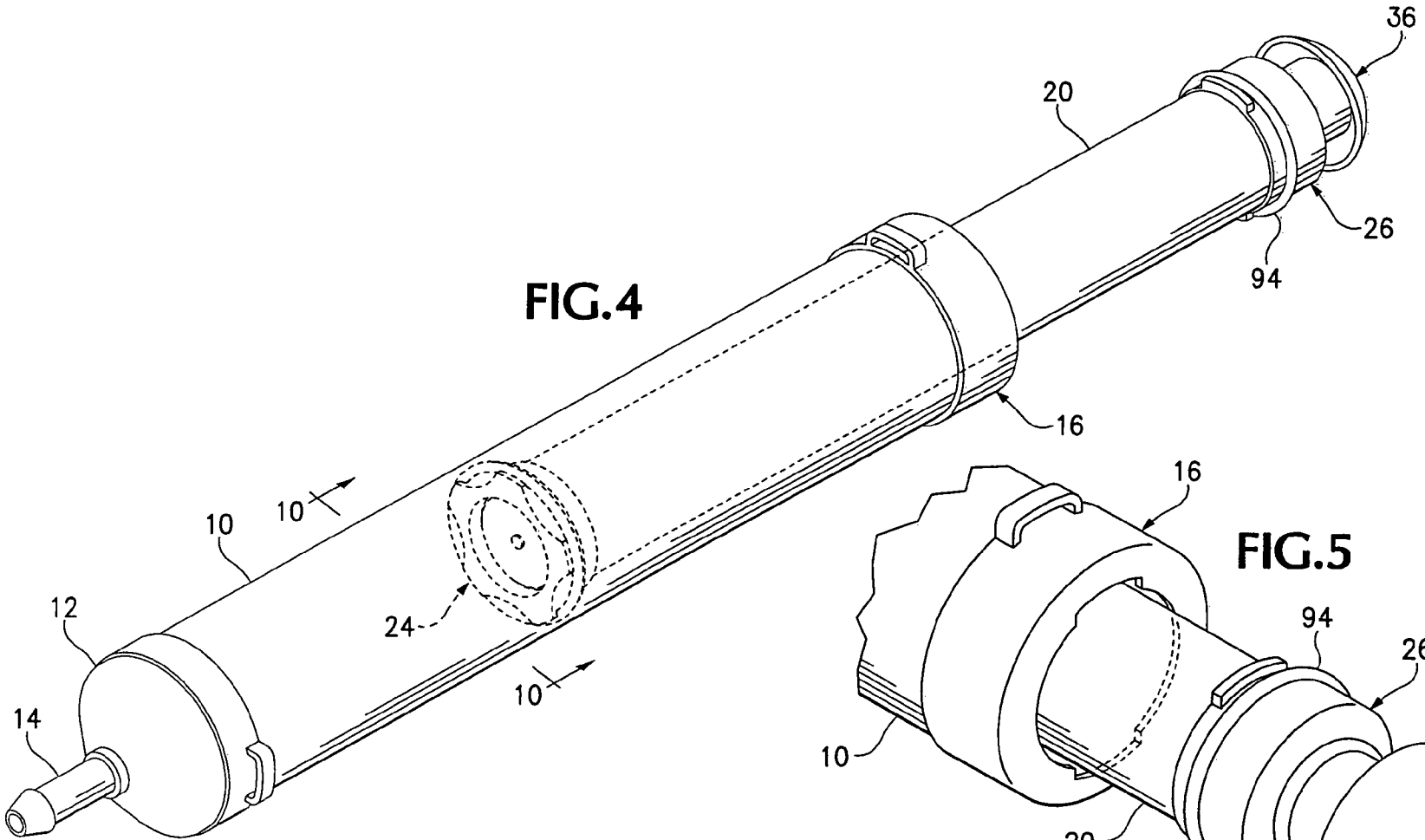
FIG. 4 is a perspective view of the pump showing a second piston in phantom.
Figure 5:
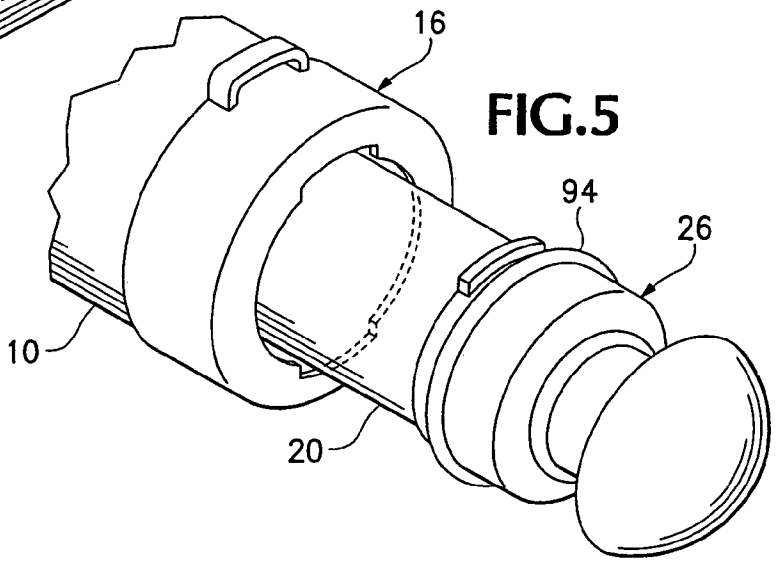
FIG. 5 is a partial perspective view corresponding to FIG. 4 viewed from another direction.
Figure 6:
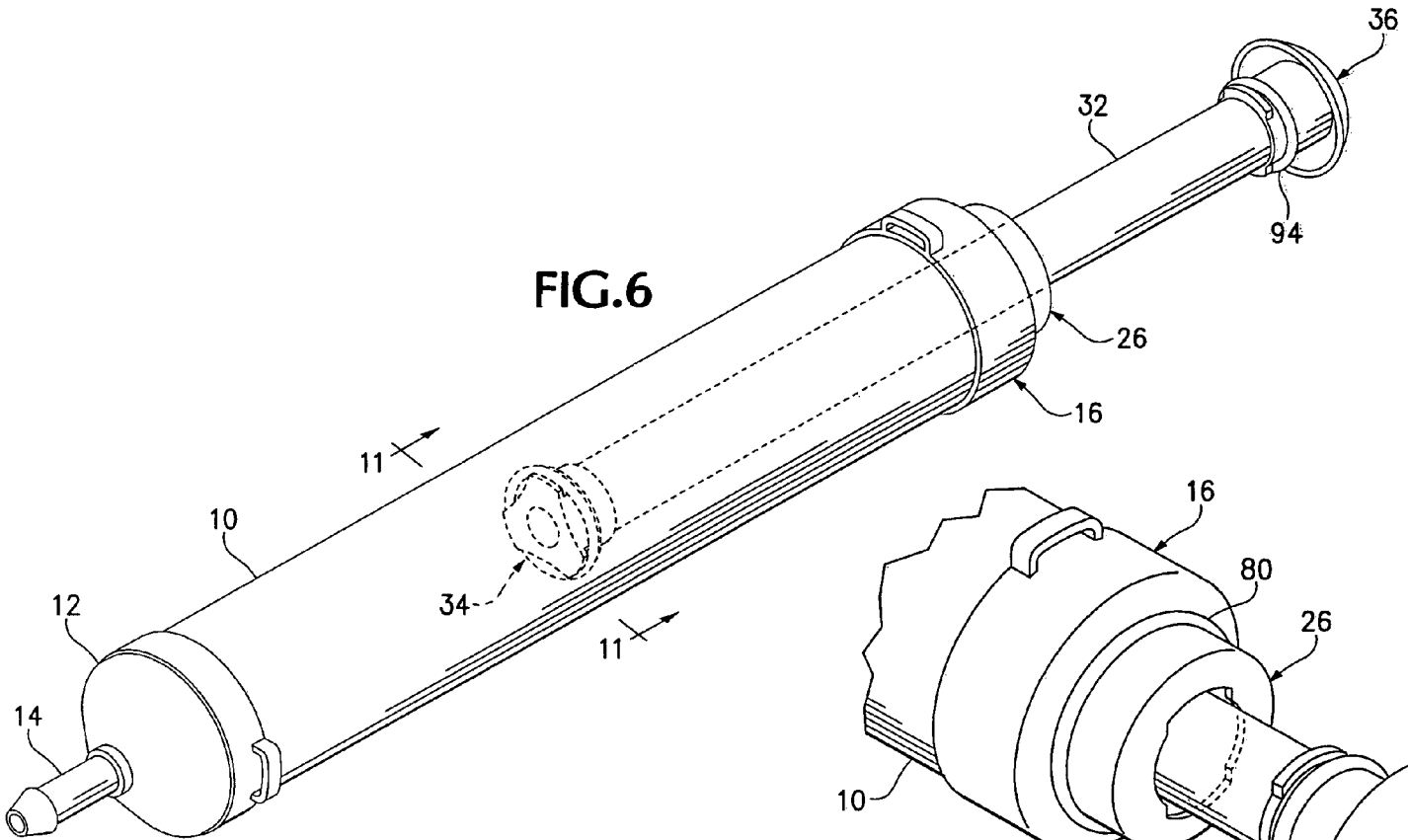
FIG. 6 is a perspective view of the pump showing a first piston in phantom.
Figure 7:
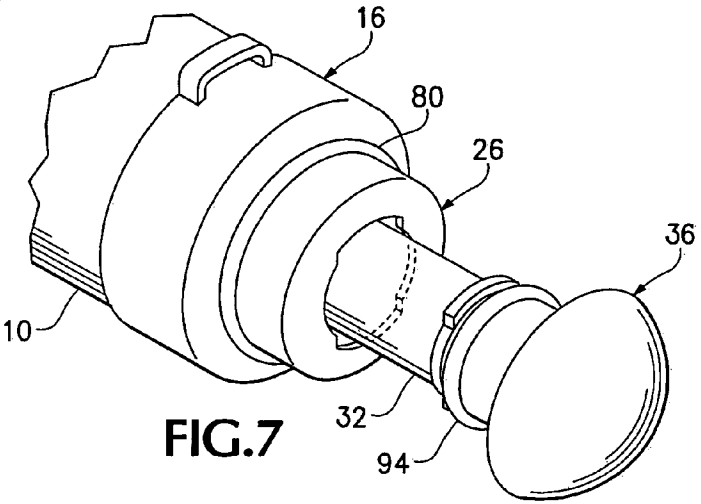
FIG. 7 is a partial prospective view corresponding to FIG. 6 viewed from another direction.

Referring now to FIGS. 1 and 2 of the drawings, a two-stage hand operated air pump includes an elongate tubular outer tube 10 which is open on each end. The outlet end of the outer tube 10 is covered by a funnel-shaped end cap 12 having an outlet 14 which is configured to fit into the air valve (not shown) of an inflatable device, such as a raft. A fitting 15 releasably attaches to the end of the outlet to allow the pump to be used with rafts having smaller air valves. The other end of the outer tube 10 is covered by a first cap 16 having an opening 18 located in it, FIG. 3. The outer tube 10 defines a cylindrical second chamber 22.

Slidably located concentrically in the outer tube is an inner tube 20 which has an outside diameter which is slightly less than the diameter of the opening 18 in the first cap 16. Located at one end of the inner tube 20 is a second piston 24 which moves in the second chamber 22 when the inner tube 20 is moved in and out of the pump. Located at the other end of the inner tube 20 is a second cap 26 which has a central opening 28 located in it, FIG. 3. The inner tube defines a cylindrical first chamber 30. A second centering ring 100 is located in the first cap 16. The second centering ring has an inner diameter which slidably receives the inner tube 20 and keeps the inner tube centered in the outer tube 10. The centering rings are made from a relatively low friction wear-resistant material. Acetal works well for this purpose but other plastic materials could be used.

Slidably located concentrically in the inner tube 20 is a plunger 32. The plunger 32 has an outer diameter which is slightly less than the opening 28 in the second cap 26. Located at one end of the plunger 32 is a first piston 34 which moves in the first chamber 30 when the plunger is moved in and out of the pump. Located at the other end of the plunger is a handle 36. A first centering ring 102 is located in the second cap 26. The first centering ring has an inner diameter which slidably receives the plunger 32 and keeps the plunger 32 centered in the inner tube 20.

Located in the end cap 12 at the outlet end of the second chamber 22 is a second check valve 38. The second check valve 38 allows air to be forced out of the second chamber 22 into the outlet 14 when the second piston is moved toward the outlet and prevents air from being drawn back into the second chamber when the second piston is moved away from the outlet. Located in the second piston 24 is a first check valve 40. The first check valve allows air to be forced out of the first chamber 30 into the outlet 14 when the first piston is moved toward the outlet 14 and prevents air from being drawn into the first chamber 30 when the first piston is moved away from the outlet 14.

Figure 8A:
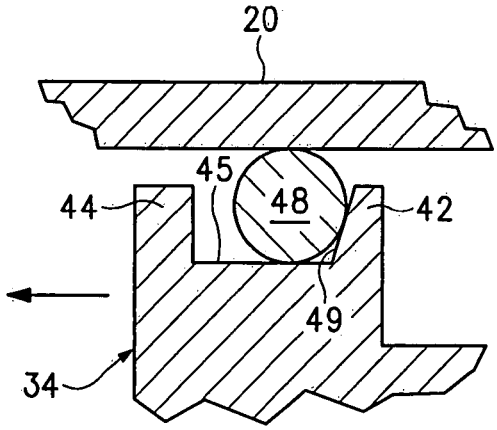
FIGS. 8A and 8B are detail views of the first piston in cross-section.
Figure 8B:
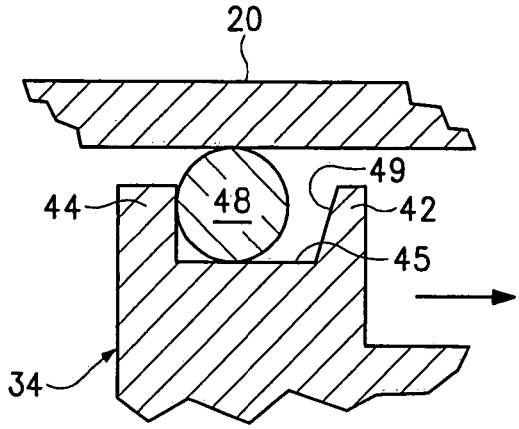
Figure 11:
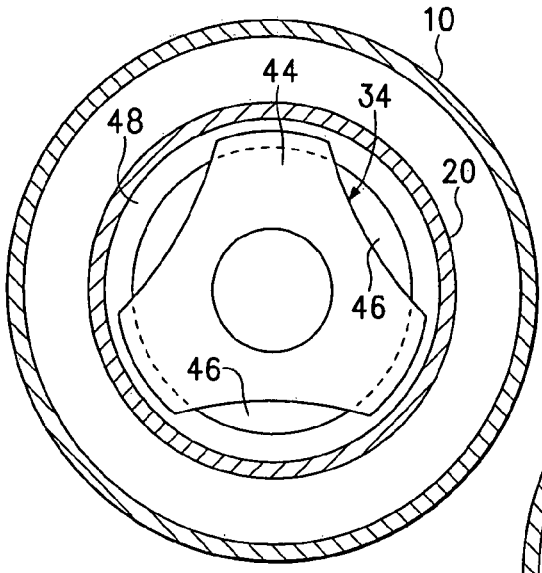
FIGS. 11 and 11A are cross-sectional views showing operation of the first piston.
Figure 11A:
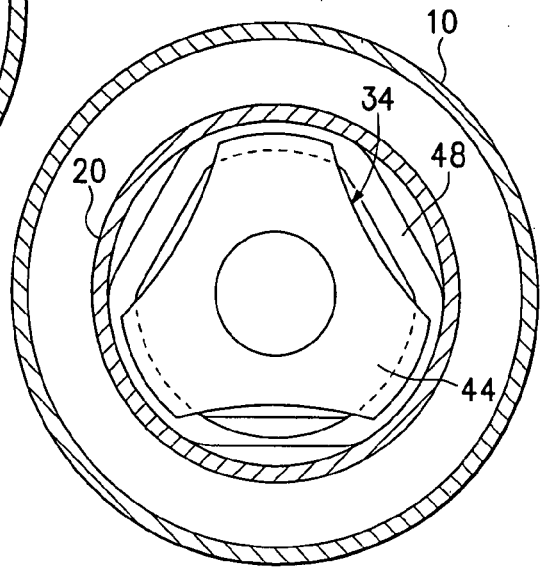

Referring now to FIGS. 8A and 8B, the first piston 34 includes a thin planar annular pressure ring 42 which has an outside diameter which is slightly less than the inner diameter of the inner tube 20. Located slightly in front of the pressure ring 42 is a thin planar annular relief ring 44 which is similar to the pressure ring 42 except that it has a series of discontinuities 46 located around its periphery FIGS. 11 and 11A. A shelf 45 extends around the periphery of the first piston between the pressure ring 42 and the relief ring 44. A first O-ring 48 rests on the shelf 45. The first O-ring is relatively hard, preferably having a 60 share durometer hardness. The relief ring 42 is separated from the pressure ring 44 by an amount that is greater than the diameter of the first O-ring 48, and the diameter of the first O-ring 48 is such that it allows the first piston to move in the first chamber and yet provides an airtight seal between them. In operation, when the plunger 32 is pushed into the pump to move the first piston 34 inwardly in the first chamber, the first O-ring 48 is urged against the pressure ring 42 and a seal is created, FIGS. 8A and 11. However, when the first piston 34 is moved outwardly in the first chamber, the first O-ring 48 is urged against the relief ring 44 and portions of the first O-ring are pushed into the discontinuities 46 in the relief ring 44 and no seal is created, FIGS. 8B and 11A. Thus the plunger can be moved outwardly in the pump without drawing any air into the first chamber. The surface 49 of the pressure ring 42 that faces toward the first O-ring is angled away from the first O-ring 48. This centers the first 0-ring 48 on the first piston which creates a better seal when the first piston is moved into the pump. In the embodiment illustrated, the entire surface 49 is angled, but only the outer portion of the first pressure ring could be angled.

Figure 10:
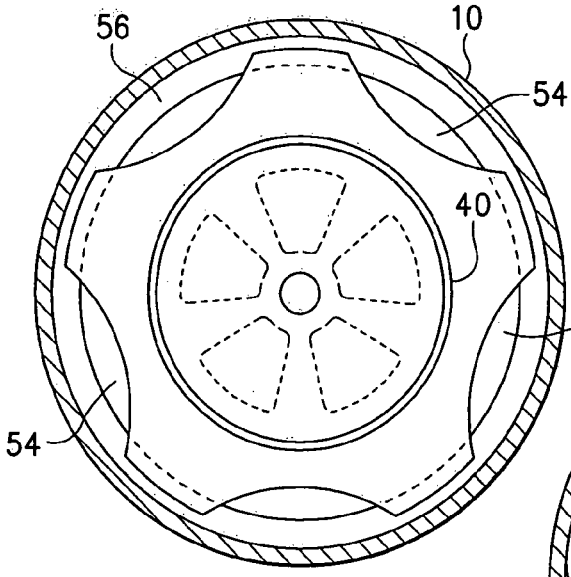
FIGS. 10 and 10A are cross-sectional views showing operation of the second piston.
Figure 10A:
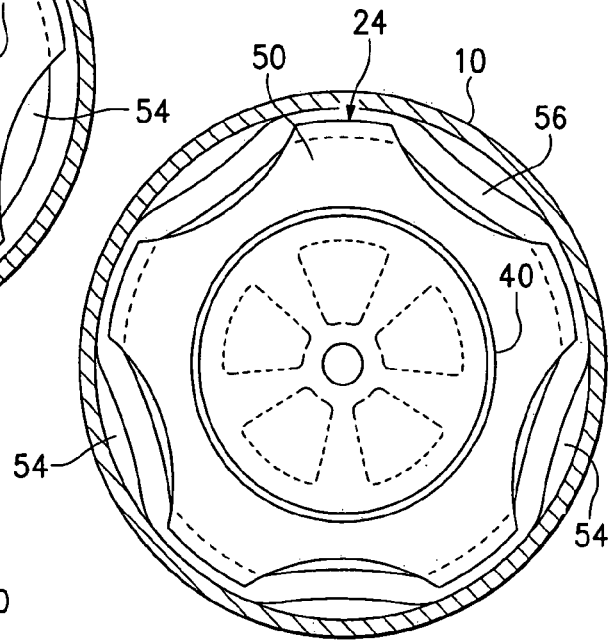

The second piston 24 includes a thin planar annular pressure ring 50 which has an outer diameter which is slightly less than the inner diameter of the outer tube 10. Located slightly in front of the pressure ring 50 is a thin planar annular relief ring 52 which is similar to the pressure ring 50 except that it has a series of discontinuities 54 located around its periphery. A shelf 58 extends around the periphery of the second piston between the pressure ring 50 and the relief ring 52. A second O-ring 56 rests on the shelf 58. The second O-ring 58 is made from a material that is similar to the material used for the first O-ring 48. The relief ring 52 is separated from its associated pressure ring 50 by an amount that is greater than the diameter of the second O-ring 56, and the diameter of the second O-ring 56 is such that it allows the second piston to move in the second chamber 22 and yet provides an airtight seal between them. In operation when the second piston 24 is moved inwardly into the second chamber 22, the second O-ring 56 is urged against the pressure ring 50 and a seal is created, FIG. 10. However, when the second piston 24 is moved outwardly in the second chamber 22 the second O-ring 56 is urged against the relief ring 52 and portions of the second O-ring are pushed into the discontinuities 54 in the relief ring and no seal is created, FIG. 10A. Like was the case with the first piston, at least the outer portion of the surface 60 of the pressure ring 50 that faces away from the second O-ring 56 is angled away from the second O-ring.

Both pistons are operated by grasping the handle 36 at the end of the plunger 32 and pulling it repeatedly outward from the pump and back inwardly into the pump. The desired piston is selected through a locking mechanism. The locking mechanism allows movement of the plunger to move the first piston 34 in the first chamber 30 without moving the second piston 24 in the second chamber 22 when the handle 36, and plunger 32, are first rotated in a first direction to a first position. However, when the handle 36, and plunger 32, are rotated in a second direction to a second position movement of the plunger 36 moves the second piston 24 in the second chamber 22 without moving the first piston 34 in the first chamber 30. The locking mechanism 62 also prevents movement of the plunger altogether when rotated to a third position which is intermediate the first and second position.

Figure 9:
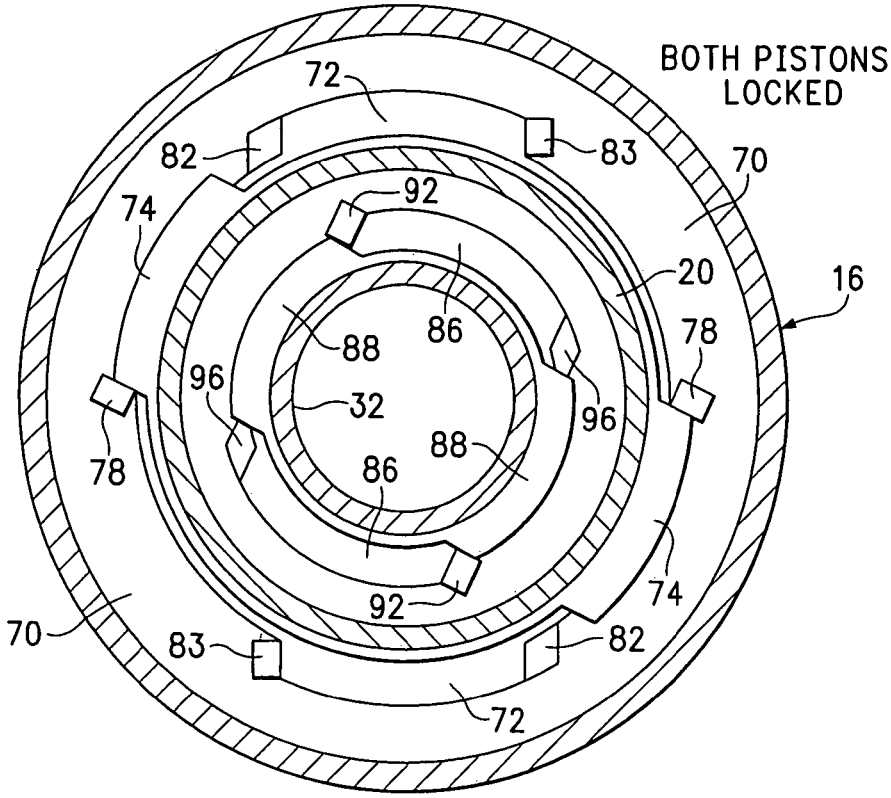
FIGS. 9, 9A and 9B are cross-sectional views taken along the line 9-9 in FIG. 1 showing details of a locking mechanism of the pump.
Figure 9A:
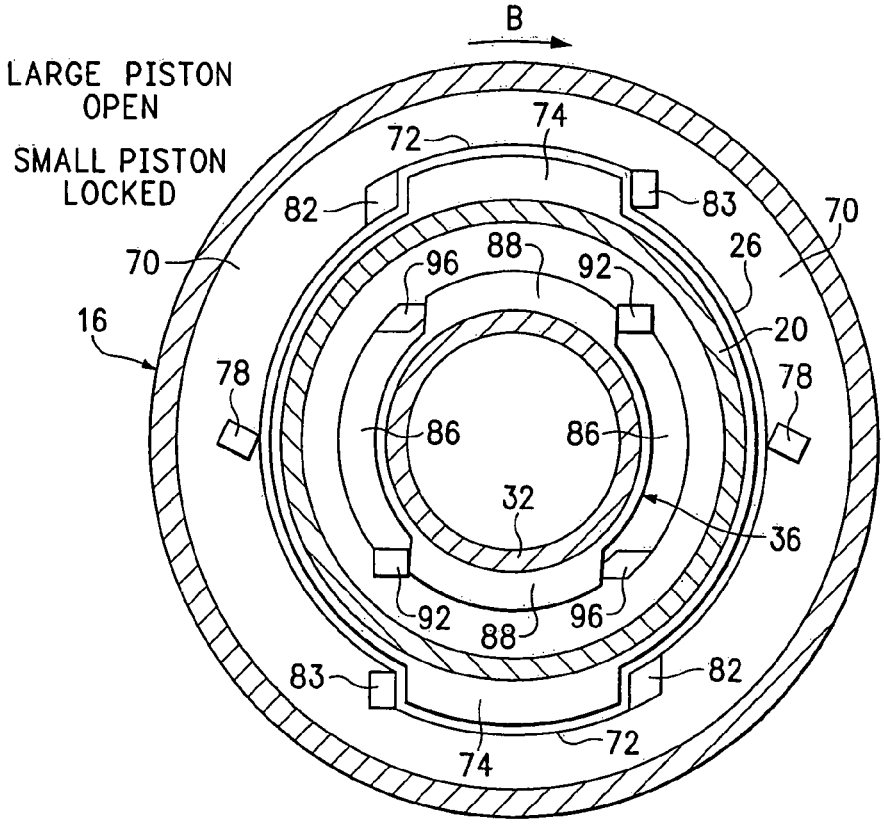
Figure 9B:
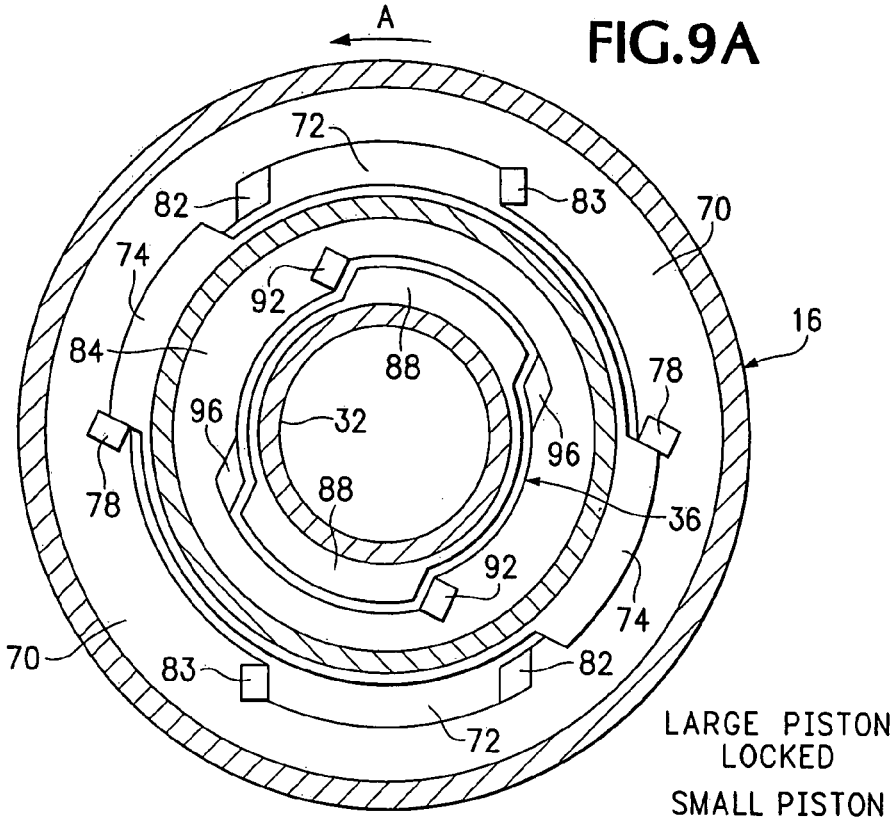

The locking mechanism includes a first lock which locks the second cap 26 to the first cap 16 when the second cap is rotated in a first direction A to a first position relative to the first cap, FIG. 9B. The first lock includes a pair of rings 70 which project into the opening 18 at the top of the first cap 16. The rings 70 are separated at each end by diametrically opposed spaces 72. A pair of diametrically opposed tabs 74 project outwardly from the bottom of the second cap 26. The tabs 74 are sized to fit into the spaces 72 between the rings 70 in the first cap. The second cap 26 has a lip 76 which is located above the tabs 74 and contacts the rings 70 when the tabs of the second cap are immediately below the rings 70 in the first cap. Rotation of the second cap in the first direction relative to the first cap causes the tabs 74 to be placed under the rings 70 which prevents the second cap 26 from being removed from the first cap 16. First stops 78 extend below the rings 70 to prevent rotation of the second cap past a first position where the first tabs are located fully beneath the rings 70. A first O-ring 80 located on the second cap 26 below the lip 76 must be compressed slightly for the tabs 74 to fit under the rings 70 which prevents unintentional rotation of the second cap relative to the first cap. A ramp 82 located at the end of each first ring 70 facilitates compressing the first O-ring when the second cap is rotated in the first direction relative to the first cap. Second stops 83 extend below the rings 70 to prevent rotation of the second cap relative to the first cap in a second, opposed, direction, The locking mechanism 62 also includes a second lock which locks the handle 36, and thus the plunger 32, to the second cap 26 when the handle is rotated in a second direction B to a second position relative to the second cap 26, FIG. 9A. The second lock includes a pair of rings 84 which project into the opening 28 at the top of the second cap. The rings 84 are separated at each end by diametrically opposed spaces 86. A pair of diametrically opposed tabs 88 project outwardly from the bottom of the handle 36. The tabs 88 are sized to fit into the spaces 86 between the rings 84 in the second cap 26. The handle 36 has a lip 90 which is located above the tabs 88 and contacts the rings 84 when the tabs 88 are immediately below the rings 84 in the second cap 26. Rotation of the handle 36 relative to the second cap 26 in the second direction causes the tabs 88 to be placed under the rings 84 which prevents the handle 36 from being removed from the second cap 26. Stops 92 extend below the rings 84 to prevent rotation of the handle 36 past a second position when the tabs 88 are fully below the second rings 84. A second O-ring 94 located on the handle 36 below the lip 90 must be slightly compressed for the tabs 88 to fit under the rings 84 which prevents unintentional rotation of the handle relative to the second cap. A ramp 96 located at the end of each second ring 84 facilitates compressing the second O-ring when the handle is rotated relative to the second cap.

In operation by rotating the handle in the first direction A, the first lock is engaged and the second lock is disengaged. In this position movement of the handle causes movement of the first piston 34 in the first chamber 30 without moving the second piston 24 in the second chamber 22. When the handle 36 is rotated in the opposite or second direction B, the first lock is disengaged and the second lock is engaged. In this position movement of the handle causes movement of the second piston 24 in the second chamber 22 without movement of the first piston in the first chamber. Thus, the pump can either create a high volume of air to fill a raft, or create a lower volume of air in order to accommodate the higher pressure when topping off the raft. Air is drawn into the first chamber when the first piston is pulled away from the pump through the space between the plunger and the second cap, and air is pulled into the second chamber when the second piston is pulled outwardly in the pump through the gap between the inner cylinder and the first cap.

While most raft inflation fittings have built-in check valves, the check valves 34 and 38 prevent air from passing between the first and second chambers when the pump is being used.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A two-stage pump comprising:

(a) a first chamber defined by a first chamber wall;

(b) a first piston which is movably located in said first chamber;

(c) a plunger which is attached to said first piston;

(d) a second chamber defined by a second chamber wall;

(e) a second piston which is movably located in said second chamber;

(f) a locking mechanism which causes activation of said plunger to move said first piston in said first chamber without moving said second piston in said second chamber when said plunger is rotated in a first direction to a first position, and causes activation of said plunger to move said second piston in said second chamber without moving said first piston in said first chamber when said plunger is rotated in a second direction to a second position; wherein said second piston comprises:

[i] an annular pressure ring having an outer diameter which is slightly less than an inner diameter of said first chamber;

[ii] an annular relief ring which is spaced apart from said pressure ring and has an outer diameter substantially equal to the outer diameter of said pressure ring;

[iii] said relief ring having a plurality of discontinuities located about its periphery;

[iv] an O-ring which fits between said pressure and relief rings to seal said first piston in said first cylinder;

[v] aid O-ring, said pressure ring, said relief ring and said discontinuities being arranged such that when said first piston is moved into said first chamber said O-ring forms a seal between said pressure ring and said first chamber wall, and when said first piston is moved out of said first chamber said O-ring collapses into said discontinuities such that said O-ring does not form a seal between said relief ring and said first chamber wall.

2. A two-stage pump comprising:

(a) a first chamber defined by a second chamber wall;

(b) a first piston which is movably located in said first chamber;

(c) a plunger which is attached to said first piston;

(d) a second chamber defined by a second chamber wall;

(e) a second piston which is movably located in said second chamber:

(f) a locking mechanism which causes activation of said plunger to move said first piston in said first chamber without moving said second piston in said second chamber when said plunger is rotated in a first direction to a first position, and causes activation of said plunger to move said second piston in said second chamber without moving said first piston in said first chamber when said plunger is rotated in a second direction to a first position; wherein said second piston comprises:

[i] an annular pressure ring having an outer diameter which is slightly less than an inner diameter of said second chamber;

[ii] an annular relief ring which is spaced apart from said pressure ring and has an outer diameter substantially equal to the outer diameter of said pressure ring;

[iii] said relief ring having a plurality of discontinuities located about its periphery;

[iv] an O-ring which fits between said pressure and relief rings to seal said second piston in said second cylinder;

[v] Said O-ring, said pressure ring, said relief ring and said discontinuities being arranged such that when said second piston is moved into said second chamber said O-ring forms a seal between said pressure ring and said second chamber wall and when said second piston is moved out of said second chamber said O-ring collapses into said discontinuities said O-ring does not form a seal between said relief ring and said second chamber wall.

3. A piston for an air pump which communicates within a chamber, comprising:

(a) An annular pressure ring having an outer diameter which is slightly less than an inner diameter of said chamber;

(b) an annular relief ring which is spaced apart from said pressure ring and has an outer diameter substantially equal to the outer diameter of said pressure ring;

(c) said relief ring having a plurality of discontinuities located about its periphery;

(d) an O-ring which sits between said pressure and relief rings to seal said piston in said chamber; wherein (e) said O-ring, said pressure ring, said relief ring and said discontinuities being arranged such that when said piston is moved into said chamber said O-ring forms a seal around the periphery of said pressure ring and when said piston is moved out of said chamber said O-ring collapses into said discontinuities and does not form a seal around the periphery of said relief ring.

* * * * *